United States Patent [19]

Baden et al.

[11] 4,036,715

[45] July 19, 1977

[54] METHOD OF RECOVERING SILVER FROM PHOTOGRAPHIC BLEACH-FIX AND CONCURRENTLY REGENERATING THE BLEACH-FIX

[75] Inventors: Harry C. Baden; Charleton C. Bard; Donald J. Brugger, all of Rochester, N.Y.

[73] Assignee: Eastman Kodak Company, Rochester, N.Y.

[21] Appl. No.: 209,748

[22] Filed: Dec. 20, 1971

[51] Int. Cl.[2] ..... C25C 1/20; G03C 5/38

[52] U.S. Cl. ..... 204/109; 96/60 BF

[58] Field of Search ..... 204/104–111; 96/60 BF, 50

[56] References Cited

U.S. PATENT DOCUMENTS

| | | | |
|---|---|---|---|
| 3,554,883 | 1/1971 | Green | 204/109 |
| 3,616,332 | 10/1971 | Miller | 204/109 |
| 3,667,950 | 6/1972 | Amano et al. | 96/60 BF |

FOREIGN PATENT DOCUMENTS

| | | | |
|---|---|---|---|
| 810,151 | 4/1969 | Canada | 96/60 BF |

OTHER PUBLICATIONS

"Prep'n of Thick Coats of W," by McCawley et al., U.S. Bur. of Mines Report of Investigations 6454, 1964, pp. 7, 9.

"Metal Coating of Plastics," by F. A. Lowenheim, pp. 185–187.

"Electroless Plating Baths," Metal Finishing Guidebook Directory, 1968, p. 496.

*Primary Examiner*—R. L. Andrews

*Attorney, Agent, or Firm*—T. N. Dahl

[57] ABSTRACT

An improved practical and highly efficient electrolytic method for concurrently recovering silver from photographic bleach-fix solutions which contain iron, and regenerating the bleach-fix for reuse. A substantial improvement in current efficiency at low current densities is realized by a combination of (a) adding a reductant such as sodium dithionite before electrolysis, as a reducing agent for ferric ions in the bleach-fix solution, (b) maintaining a non-oxidizing atmosphere in the cell, and (c) providing either a cation permeable membrane or a porous alundum membrane between the electrolytic cell anode and cathode, to separate a first pool of bleach-fix catholyte from a second pool of a different salt solution such as sodium carbonate as anolyte.

5 Claims, 5 Drawing Figures

METHOD OF RECOVERING SILVER FROM PHOTOGRAPHIC BLEACH-FIX AND CONCURRENTLY REGENERATING THE BLEACH-FIX

BACKGROUND OF THE INVENTION

1. Field of the Invention

The present invention relates to a method and apparatus for recovering silver from spent photographic bleach-fix solutions containing iron, and concurrently regenerating the bleachfix. It relates more specifically to such a technique which utilizes and electrolytic cell to plate out and recover silver.

2. Prior Art

Electrolytic techniques for the recovery of silver from spent photographic solutions are well known, eg. as described in U.S. Pat. No. 1,629,212 to Giffer for treating a spent "hypo" fix.

The efficiencies of prior electrolytic systems were satisfactory for the recovery of silver from the thiosulfate fix solution (or hypo) of the aforementioned patent. However, when the same techniques were applied to spent bleach-fix solutions containing soluble ferric iron ions, for example, such soluble iron complexes as ferric EDTA (ethylenediaminetetraacetic acid), the efficiency at acceptably low current densities was found to be much too low to be practical. We have concluded that such reduced efficiency is mainly due to the consumption of electrons by a competing cathode reaction whereby iron III is reduced to iron II before the slver is reduced. Concurrently there is a reoxidation of iron II back to iron III at the anode. Thus, current densities several times as great as normally required in silver recovery cells are required to obtain the same yields of silver.

SUMMARY OF THE INVENTION

In accordance with the present invention we have provided an improved technique for the electrolytic recovery of silver from spent aqueous bleach-fix photographic solutions containing soluble ferric iron, which technique is efficient enough at low current densities to render its use practical. Furthermore, the bleach-fix solution is regenerated, and can be reused for photographic processing.

Having postulated that the drastically lowered efficiency experienced in electrolytic silver recovery from spent bleach-fix photographic solutions is in large part due to a competing cathode reaction whereby ferric ion is reduced to ferrous ion at the cathode, aggravated by the production of more ferric ion from oxidation of ferrous ion at the anode and from contact with air, we have devised a novel procedure for eliminating these competing reactions.

The improvement of the present invention comprises, as a first step, chemically reducing the ferric ion to ferrous ion by adding to the spent bleach-fix solution a suitable ferric-to-ferrous ion reductant, for example, sodium dithionite, sodium formaldehydesulfoxylate, hydrazine, morpholine borane, dimethylamine borane, hydroxylamine sulfate, or aminoiminomethanesulfinic acid. This chemical addition eliminates the initial competing reaction at the cathode.

Then the direct current electrolysis is performed while excluding air from the cell to prevent the production of ferric ion by oxidation, as by evacuating the cell or by blanketing the cell with an inert non oxidizing gaseous atmosphere (e.g. $N_2$, or $CO_2$), and while also isolating the anode in a separate replaceable anolyte solution to prevent reoxidation of Fe II to Fe III at the anode. Isolation is accomplished by a barrier of either a cation permeable membrane (which is not porous and is not permeable to anions), or a porous membrane (which is permeable to both anions or cations) positioned between the anode and cathode to block access of bleach-fix to the anode, and thus prevent the production of ferric ion from ferrous ion at the anode. When all three of these new techniques are combined in the electrolytic recovery of silver from spent bleach-fix solutions, a surprisingly large improvement in current efficiency results at low current densities (when compared with efficiencies of the prior art at similar current densities), with efficiencies as high as 60–70% being secured; and the bleach-fix solution is also regeneratable for reuse.

The bleach-fix is then regenerated by introducing air therein to oxidize iron II back to iron III, as described in U.S. patent application Ser. No. 8026 filed Feb. 2, 1970 and issued Jan. 11, 1972 as U.S. Pat. No. 3,634,088.

THE DRAWINGS

THE PREFERRED EMBODIMENTS

The Method

Figure 1:
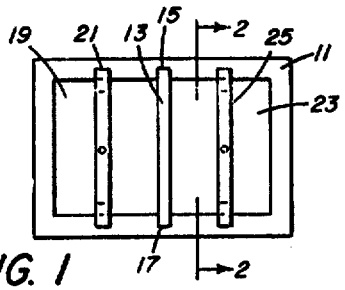
FIG. 1 is a plan view of an electrolytic cell (with cover removed) containing a barrier such as a cation permeable membrane, for performing the method of the invention.

The spent photographic solutions suitable for treatment in accordance with our improved method are those containing both silver ions and complexed ferric ion.

Specifically susceptible to treatment by our method, after becoming spent in photographic processing, are the widely utilized bleach-fix solutions which contain ferric complexes as the bleaching compounds.

In recent years the fixing solution has been combined with a bleaching solution so that the fixing and bleaching of a photographic film or paper can be performed in one operation. In such a bleach-fix solution the fixing compound comprises sodium or ammonium thiosulfate, and the bleaching compound generally comprises ammonium ferric EDTA (ethylenediaminetetraacetic acid). U.S. Pat. No. 3,634,088, based on application Ser. No. 8,026, describes such a bleach-fix. When the bleach-fix solution has become spent or exhausted a considerable amount of the ammonium ferric EDTA or other complex has been converted by reduction to ammonium ferrous EDTA or other complex; and the solution has become so loaded with silver compounds that it can no longer be used efficiently as a bleach-fix without possible loss of silver.

Bleach-fix solutions to which the method of this invention is applicable are solutions comprising a water-soluble thiosulfate which serves as the fixing agent. As is well known, thiosulfates which are useful for this purpose include ammonium thiosulfate and alkali metal thiosulfates such as sodium thiosulfate and potassium thiosulfate.

Ferric salts of aminopolycarboxylic acids are included as bleaching agents in bleach-fix formulations. Illustrative examples of the aminopolycarboxylic acids are the following:

nitrilotriacetic acid,
ethylenediamine tetraacetic acid,
diethylenetriamine pentaacetic acid,
ortho-diamine cyclohexane tetraacetic acid,
ethylene glycol bis(aminoethyl ether) tetraacetic acid,
diaminopropanol tetraacetic acid,
N-(2-hydroxyethyl)ethylenediamine triacetic acid,
ethyliminodipropionic acid, and the like. The ferric salts of aminopolycarboxylic acids utilized in the practice of this invention may be salts in which all cations are the ferric ion, or salts in which one or more of the carboxyl groups have formed a salt with a cation. An example of such a salt is sodium ferric ethylenediamine tetraacetate. The bleach-fix may also contain a non-chelated salt of an aminopolycarboxylic acid, eg. the tetra sodium salt of ethylenediamine tetraacetic acid, in addition to the ferric salt.

While the above described fixing agents and bleaching agents are the essential components of bleach-fix formulations to which the method of this invention is applicable, the bleach-fix solutions will usually also include other addenda known to the art to be useful for incorporation in bleach-fix formulations. Thus, for example, they may include an additional silver halide solvent such as water-soluble thiocyanate, as well as such compounds as ammonium bromide, alkali metal bromides, amines, sulfites, and mercaptotriazoles. The concentration of thiosulfate in the bleach-fix solution is typically from about 5 to about 500 grams per liter, and the concentration of the ferric salt of an aminopolycarboxylic acid is typically from about 5 to about 200 grams per liter.

Silver can be electrolytically recovered from a spent photographic solution having a silver ion($Ag^+$) concentration ranging from about 3 to about 6 g/l in a direct current electolytic cell using a voltage of about 2 volts and a current of between about 0.5 and about 5 amps/ft$^2$. Under these conditions, silver will generally plate out at a rate of only about 0.5 g/amp hr. when the solution contains iron III, whereas plating under similar conditions in the absence of ferric iron is at a rate of about 3.6 g/amp hr.

It has now been found possible to greatly increase plating efficiency in the presence of iron III by a novel combination of three novel procedures, each of which alone offers some improvement, but which together provide a surprisingly large and significant improvement. These three novel procedures comprise:

1. adding a ferric-to-ferrous ion reductant compound to the spent bleach-fix solution to be treated;

2. blanketing the inside of the electrolytic cell with an inert non oxidizing gaseous atmosphere above the electrolyte level; and 3. isolating the anode in a separate replaceable anolyte solution by positioning a cation permeable membrane or a porous barrier between the anode and the cathode.

The ferric ion reductant compound which is added to the spent solution from which silver is to be recovered may be selected from the reducing agents previously mentioned which are compatible and non-corrosive in the system. However, especially preferred among such reductants are sodium dithionite and hydroxylamine sulfate, both of which are photographically useful and compatible with the electrolyte systems under discussion.

The amount of ferric ion reductant which should be added to a given solution will vary to some degree depending upon the amount of ferric iron present in the electrolyte solution, the composition of the balance of the solution, and the rate at which it is sought to plate out the silver (or conversely, the current density utilized in the recovery operation). Generally, however, a concentration of reductant ranging from about 0.1 to about 50 g/l, but below solution saturation, has proven effective to increase the plating efficiencies in these systems. Specifically preferred in the successful practice of the improved method of the present invention are reductant-to-ferric ion equivalent ratios of about 1 to 1, although current efficiency improvement is observed at even lower levels of reductant concentration.

It has been found advantageous for securing the desired substantial increases in current efficiency that the cell be blanketed during operation with an inert non oxidizing gaseous atmosphere such as $N_2$ or $CO_2$ to exclude atmospheric oxygen which tends to reoxidize the reduced ferrous ion.

Finally, in order to achieve optimum results, the anode is located in an aqueous anolyte solution of expendable salt such as sodium carbonate, and is isolated from the spent aqueous bleach-fix catholyte solution by a cation permeable membrane or a porous barrier which excludes bleach-fix from the anode, thereby avoiding reoxidation of iron II to iron III and insuring maximum efficiency for the plating of $AG^+$ ions at the cathode without interference by other cationic species. Suitable membranes which can be used are cationic permeable resin on a suitable support, or a porous plate or jacket of alundum sintered aluminum oxide. The former are described in U.S. Pat. No. 3,291,713, and other patents mentioned therein.

The Apparatus

Figure 2:
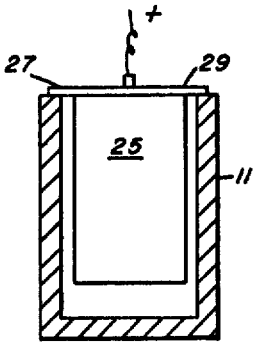
FIG. 2 is a cross sectional view taken along the line 2—2 in FIG. 1.

The method as described in detail above can be performed successfully in the apparatus shown in FIGS. 1–4 of the drawings which are designed for a batch type operation. The electrolytic cell comprises a container 11 of dielectric material such as glass or plastic, or of a corrosion resistant metal such as chrome-nickel stainless steel, having a membrane 13 midway therein and fitting in grooves 15 and 17 in the side wall of the cell, thus dividing the cell into a catholyte chamber 19 within which is suspended a cathode plate 21 and an anolyte chamber 23 within which is suspended an anode plate 25. As shown in FIG. 2 the anode 25 includes two shoulders 27 and 29 which rest on the top surface of container 11, the shoulders being of dielectric material when container 11 is a conductor. Cathode 21 is similarly constructed. The electrodes are adapted to be connected to opposite sides of a battery or other source of direct current.

Figure 3:
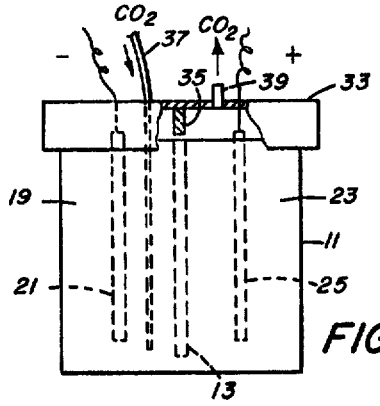
FIG. 3 is a side elevational view, partly in section, of the electrolytic cell of FIGS. 1 and 2, showing a cover in position on top of the cell.

Referring to FIG. 3, when the method is in operation the catholyte chamber 19 is filled with spent bleach-fix solution, and the anolyte chamber 23 is filled with an aqueous solution of a salt such as sodium carbonate. If the iron III reductant compound has not been added to the bleach-fix before entering the cell, it is then added in the cell. A cover 33, which can be of dielectric material, is then fitted tightly over the top of the container 11 so as to exclude atmospheric air from contact with the electrolytes. Cover 33 includes a transverse baffle 35 which extends close to but spaced slightly from the top of membrane partition 13 so as to prevent splashing of liquid from one side of the partition to the other. $CO_2$ is introduced through a tubular sparger 37 on the plating side of cathode 21, to agitate the catholyte and to preclude the ingress of air to the cell.

Figure 4:
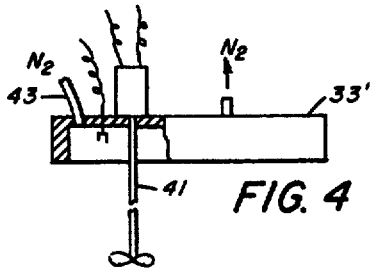
FIG. 4 is a side elevational view partly in section, showing an alternative form of cover for the electrolytic cell.
Figure 5:
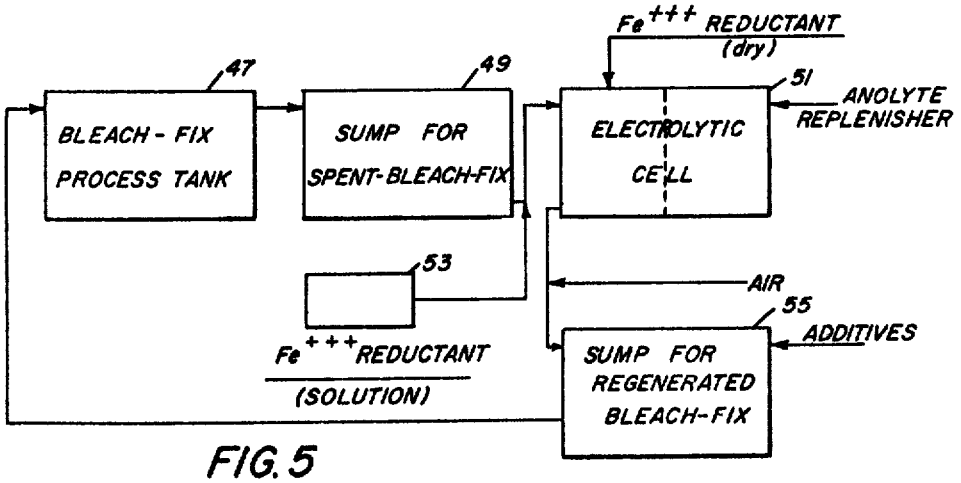
FIG. 5 is a schematic flow diagram showing the passage of spent bleach-fix solution from a film processing tank to the electrolytic cell for silver recovery, followed by bleach-fix regeneration; and then passage of the regenerated bleach-fix solution back to the process tank.

In FIG. 4 the cover 33' includes a motor driven propeller 41 for catholyte agitation, instead of the sparger 37. A non oxidizing atmosphere of nitrogen gas is introduced through an inlet 43.

The bleach-fix can also be regenerated by continuously flowing it from a photographic processing tank 47 into a sump 49, and then into the top of the cell 51. Before the bleach-fix enters cell 51 a stream of ferric iron reductant, such as an aqueous solution, is bled in from a vessel 53. Alternatively, the reductant can be added as a dry powder directly to the cell 51, this being particularly advantageous for sodium dithionite which tends to decompose in water.

Electrolysis conditions are maintained continuously in cell 51, and the bleach-fix, minus silver, is continuously withdrawn to a sump 55 from which it can be bled back into the processing tank 47 as needed.

Regeneration in both batch and continuous operations is accomplished by introducing oxidizing air into the bleach fix to reoxidize iron II to iron III after electrolysis, as described in U.S. Pat. No. 3,634,088. For example, air is introduced into the conduit between cell 51 and tank 47, or into the sump 55. Chemicals may be added to replenish any of the bleach-fix ingredients that have been depleted below optimum levels.

EXAMPLES

The following examples will serve to demonstrate the individual effects of each of the three modifications of conventional electrolytic techniques which contribute to the over all improvement of greatly increased current efficiency, as well as to demonstrate the improved results achieved with our full combination system.

Examples A, B, C

The rates of electrolytic silver removal from an aqueous bleach-fix solution that contains 3 g/l of silver are measured under the following conditions in a cell blanketed with nitrogen. The solution contains 91.5 ml of $NH_4$ Fe EDTA (0.143 mol/l), 200ml of $(NH_4)_2S_2O_3$ (1.8 mol/l), 4 g of KI 20 g of $Na_2SO_3$ (0.159 mol/l), and has a pH of 6.4 at 80° F.

A. Electrolytic treatment without either anode isolation, or chemical reduction of Iron III to iron II.

B. Electrolytic treatment with the anode isolated by a cationic permeable membrane in a cell with a catholyte capacity of 1.5 liters, but without chemical reduction of iron III to iron II.

C. (The Invention) — Electrolytic treatment with both anode isolation (as in B), and chemical reduction of iron III to iron II by adding 0.078 mol per liter of sodium dithionite (the stoichiometric equivalent of the iron III present).

The average rates of silver removal in the above systems for the first 3 grams of silver removed are 0.215 g/hour at 1 ampere (in condition A); 0.549 g/hour at one ampere (in condition B); and 1.3 g/hour at only 0.5 ampere (for condition C — the invention). Overall current efficiencies observed after the slver concentration is reduced to 0.5 g/l under the conditions listed above are 5.4%, 13.7% and 65.0% respectively.

Examples D, E, F (no barrier)

Electrolysis is conducted in a 5 liter capacity system with a 1 liter glass battery jar containing a graphite anode and a stainless steel anode spaced 8 cm. apart, each having an area of 81 sq. cm., and without a barrier between. Bleach-fix solution is recirculated through the cell from a reservoir, and agitation in the cell is by a propeller. The bleach-fix solutions contain 91.5 ml $NH_4Fe$ EDTA (0.143 mol/l), 200 ml $(NH_4)_2S_2O_3$ (1.18 mols/l), 20 g $NA_2SO_3$ (0.159 mols/l), 4 g KI, and $Ag^+$ as indicated, and has a pH of 6.4 at 80° F.

The surfaces of electrolytes in the cell are blanketed with nitrogen. Current density is very high, 46 amps/sq. ft. Silver removal rates are shown in Table I.

D. A bleach-fix solution having a silver concentration of 2.89 g/l is electrolyzed for 7¼ hours, without either chemical addition or use of a barrier. The current efficiency is only 11.3%.

E. Hydroxylamine (H.A.) is added to the bleach-fix solution containing 2.84 g/l of silver in an amount equal to 95% of the stoichiometric level required to reduce all iron III to iron II (18.5 g/l per 0.142 mol Fe), and the solution electrolyzed for 7 hours. Current efficiency is 14.6%.

F. 0.071 mol of sodium dithionite (NaD) is added to a bleach-fix solution containing 2.73 g/l of silver and 0.142 mol of iron III and electrolyzed for 5 hours. Current efficiency at the high current density of 46 amps. sq. ft. is 40%.

Table I

| | silver content g/l | | |
|---|---|---|---|
| Hours | D | E (H.A.) | F (NaD) |
| 0 | 2.89 | 2.79 | 2.82 |
| 1 | 2.87 | 2.58 | 1.44 |
| 2 | 2.70 | 2.16 | .55 |
| 3 | 2.44 | 1.56 | .49 |
| 4 | 1.95 | 1.00 | .45 |
| 5 | 1.40 | .58 | |
| 6 | 0.94 | .16 | |
| 7 | .45 | | |

When comparing Examples D, E and F on the basis of time required to remove the first 10 grams of silver, the efficiencies at 46 amps/sq. ft. current density are 12%, 15%, and 44% respectively.

Example G (The Invention)

A cell as shown in FIGS. 1-3, having a one-sixteen inch thick cationic permeable membrane 13 of cationic resin (sulfonated copolymer of styrene and divinyl benzene) cast over a Dynel webbing, has two equal compartments of 1500 ml volume, within which are positioned a stainless steel cathode and a graphite anode, each of 0.25 sq. ft. area. The anolyte in compartment 23 is a 0.5 molar aqueous solution of sodium carbonate. The catholyte in compartment 19 is an aqueous bleach-fix having a pH at 80° F of 6.0, and containing 135.0 ml of $NH_4Fe$ EDTA (0.211 mol/l), 300.0 ml of $(NH_4)_2$ $S_2O_3$ (1.77 mols/l), 8.0 g of KI, 10.0 g of sodium salt of paratoluene sulfinic acid, and 3 g/l of $AG^+$.

During electrolysis the catholyte is agitated with carbon dioxide supplied through a fritted glass sparger 37. Current is supplied by a Lambda Model 119 direct current power supply with incorporated automatic voltage and current control.

Electrolysis is run at a current density of only 2 amps/ft$^2$, with just sufficient sodium dithionite (12.3 g/l) having been added to reduce all of the iron III to iron II. The $Ag^+$ content decreases with time as follows:

Table II

| Hours | Ag g/l |
|---|---|
| 0 | 2.92 |
| 1 | 1.90 |
| 2 | 1.00 |
| 2.83 | .40 |

An efficiency of 50% is attained, even though current density is only 2 amps/sq.ft.

Example H (The Invention)

Following the procedure of Example G, a catholyte is treated containing 91.5 ml of $NH_4$ Fe EDTA (0.143 mol/l), 125 ml of $(NH_4)_2S_2O_3$ (0.648 mol/l), 2.95 g/l of $Ag^+$, and 12 g/l of added sodium sulfite (0.095 mol/l), and having a pH of 6.8 at 80° F, with the following results:

Table III

| Time | $Ag^+$ |
|---|---|
| 0 | 2.95 |
| 1 | 1.72 |
| 2 | .66 |
| 2.75 | .29 |

current efficiency is 62%.

Among the variants of our method that can be adopted within the scope of the invention are the following:

Iron III Reductants

While eight iron reductant compounds have been named above, other compounds that reduce iron III to iron II can be used either dry or in aqueous solution. Persons skilled in the art can readily appraise the utility of any selected iron reductant by stirring portions into 100 ml. of spent aqueous bleach-fix solution in a flask while purging with nitrogen. The criteria for a usable reductant are that it not change the bleach-fix formulation significantly, that when added in an amount stoichiometrically required to convert iron III to iron II it not precipitate silver or silver compounds before all of the iron III is reduced, that it be specific for iron, and that it act fairly rapidly. Among reductants that do not meet these tests because they do not appear to reduce iron III, or because they precipitate silver or silver compounds before all the iron III is reduced, are potassium borohydride, titanium (+3) diethylenetetraaminopentaacetic acid, and tetramethylammonium hydrotriborate.

Sodium dithionite is the preferred reductant because it acts rapidly, and when added in stoichiometric amount (without excess) for converting all iron III to iron II, reduces all the iron III before reducing any silver; and the decomposition product is only sulfite ion (from oxidation) which is not detrimental to regenerated bleach-fix. For example, an addition of 15 g/l to spent bleach-fix gives 14.2 g/l of sulfite.

A dry reductant can be fed in by a powder dispenser or feed screw; a solution in water can be injected under pressure as by pumping.

Barrier Material

A cationic permeable resinous membrane 13 (which is non permeable to anions) is preferred because such a membrane is nonporous and thus completely prevents movement of liquids between the anolyte and catholyte chambers, even when the liquid in one chamber exerts a greater pressure than that in the other, e.g. by reason of different liquid levels. A sulfonated copolymer of sytrene and divinyl benzene can be used as mentioned in U.S. Pat. No. 3,291,713; also resins as described in U.S. Pat. Nos. 2,702,272; 2,730,768; 2,731,408; and 2,731,411.

A porous membrane 13 can be used successfully as long as it is thick enough to provide tortuous paths which substantially hinder or impede the movement of liquid therethrough, for example ⅜ inch thick. Such a membrane is most effective when the pressures exerted by the anolyte and catholyte pools are about equal, as by being at the same level. Suitable porous membranes are available from the Norton Company, Refractories Division, as alundum porous mediums (fused alumina) having a porosity between 35 and 40%, and can be in the forms of flat plates, or of rectangular or cylindrical diaphragms for surrounding the anode. Also, asbestos fiber and fiberglass plates can be used. Such porous membranes are permeable to both anions and cations.

Anolyte Solution

Many compounds can be used in the anolyte solution as long as they are buffered alkaline reacting in water, e.g. sodium carbonate, potassium carbonate, alkali metal borates, -phosphates and -silicates.

Air Exclusion

Air can be excluded from the electrolytic cell by passing therethrough any gas which is inert to the electrolytes in the cell, e.g. nitrogen, argon, neon, helium, carbon dioxide, natural gas, methane, or ethane. Air exclusion can also be accomplished by drawing a vacuum on the cell.

The invention has been described in detail with particular reference to preferred embodiments thereof, but it will be understood that variations and modifications can be effected within the spirit and scope of the invention.

We claim:

1. A method for electrolytically recovering silver from spent aqueous bleach-fix photographic processing solution containing ions of both silver and iron III comprising introducing into said processing solution a chemical compound characterized by the ability to reduce iron III to iron II, impressing a direct electrical current between a cathode which is immersed in a first pool of such processing solution and an anode which is immersed in a second pool of anolyte solution of a carbonate, borate phosphate or silicate, thereby plating silver onto said cathode, said first and second pools being separated from one another by non-porous cation permeable barrier or a porous barrier, and excluding air from said pools.

2. A method in accordance with claim 1 wherein said anolyte solution is a carbonate solution.

3. A method for electrolytically recovering silver from spent aqueous bleach-fix photographic processing solution containing ions of both silver and iron III comprising introducing into said processing solution a chemical compound characterized by the ability to reduce iron III to iron II, said chemical compound being selected from the group consisting of sodium formaldehydesulfoxylate, hydrazine, morpholine borane, dimethylamine borane, trimethylamine borane, hydroxylamine sulfate, and aminoiminomethanesulfinic acid, impressing a direct electrical current between a cathode which is immersed in a first pool of such processing solution and an anode which is immersed in a second pool of anolyte solution, thereby plating silver onto said cathode, said first and second pools being separated from one another by a non-porous cation permeable barrier or a porous barrier, and excluding air from said pools.

4. A method in accordance with claim 3 wherein said chemical compound is hydroxylamine sulfate.

5. A method for electrolytically recovering silver from spent aqueous bleach-fix photographic processing solution containing ions of both silver and iron III comprising introducing into said processing solution a chemical compound characterized by the ability to reduce iron III to iron II, impressing a direct electrical current between a cathode which is immersed in a first pool of such processing solution and an anode which is immersed in a second pool of anolyte solution, of a carbonate, borate, phosphate or silicate thereby plating silver onto said cathode, said first and second pools being separated from one another by a non-porous cation permeable barrier or a porous barrier, and excluding air from said pools by introducing and maintaining over said pools an atmosphere of non oxidizing gas.

* * * * *